US008118391B2

(12) United States Patent
Snyder et al.

(10) Patent No.: US 8,118,391 B2
(45) Date of Patent: Feb. 21, 2012

(54) METHOD FOR CALIBRATION

(75) Inventors: Trevor James Snyder, Newberg, OR (US); Brian Edward Williams, Woodburn, OR (US); Susan J. Zoltner, Newberg, OR (US); Ernest I. Esplin, Sheridan, OR (US); Conor D. Kelly, Albany, OR (US)

(73) Assignee: Xerox Corporation, Norwalk, CT (US)

( * ) Notice: Subject to any disclaimer, the term of this patent is extended or adjusted under 35 U.S.C. 154(b) by 434 days.

(21) Appl. No.: 12/432,315

(22) Filed: Apr. 29, 2009

(65) Prior Publication Data

US 2010/0277540 A1 Nov. 4, 2010

(51) Int. Cl.
*B41J 29/38* (2006.01)
*B41J 29/393* (2006.01)

(52) U.S. Cl. ..... 347/19; 347/9

(58) Field of Classification Search ..... 347/19, 347/9, 14–16

See application file for complete search history.

(56) References Cited

U.S. PATENT DOCUMENTS

| | | | | |
|---|---|---|---|---|
| 6,736,478 | B2 | 5/2004 | Franzke et al. | |
| 6,755,499 | B2 | 6/2004 | Castano et al. | |
| 7,390,073 | B2 | 6/2008 | Bailey et al. | |
| 7,841,682 | B2 * | 11/2010 | Yorimoto et al. | 347/14 |
| 2001/0035889 | A1 * | 11/2001 | Mikami | 347/19 |
| 2006/0114282 | A1 | 6/2006 | Mizes et al. | |

* cited by examiner

*Primary Examiner* — Jason Uhlenhake

(74) *Attorney, Agent, or Firm* — Maginot, Moore & Beck, LLP

(57) ABSTRACT

A method of operating a printhead of an imaging device includes actuating a plurality of ink jets of the printhead to emit drops of ink onto an image receiving surface in accordance with a test pattern. The test pattern includes full pixel density areas and half pixel density areas that alternate in a process direction. Distances in a process direction between drops of the full pixel density areas and drops of the half pixel density areas in transition regions of the test pattern are then measured. The measured process direction distances are then correlated to a graininess level for the printhead.

18 Claims, 8 Drawing Sheets

METHOD FOR CALIBRATION

TECHNICAL FIELD

The present disclosure relates to imaging devices that utilize printheads to form images on media, and, in particular, to the calibration of printheads in the imaging device.

BACKGROUND

A printhead assembly of an ink jet printer typically includes one or more printheads each having a plurality of ink jets from which drops of ink are ejected towards an image receiving surface, such as a media sheet or intermediate transfer surface. During operation, drop ejecting signals activate actuators in the ink jets to expel drops of fluid from the ink jet nozzles onto the image receiving surface. By selectively activating the actuators of the ink jets to eject drops as the image receiving surface and/or printhead assembly are moved relative to each other, the deposited drops can be precisely patterned to form particular text and graphic images on the recording medium.

As is known in the art, different printheads can have various drop position differences and these can modify the intended output of an image and ultimately results in image artifacts such as banding or different levels of graininess and/or clustering. This can be true even if the resolution and drop mass generated by the printheads are the same. Such differences may be introduced from part or electronic tolerances, etc., for example, during manufacture and assembly of the printheads. There are a number of important drop position responses of a printhead which are routinely performed during manufacture and/or calibration. For example, drop position can be adjusted by modifying the driving signals to the actuators of the ink jets as well as the operating temperatures of the printheads. These adjustments have traditionally been sufficient to satisfy customer needs. This is particularly true in an ink jet printer that utilize a single printhead.

Drop position differences are more of an issue when two or more printheads are arranged side by side in an imaging device. Differences in the graininess of images produced by printheads arranged side by side in a printer can result in more severe visually noticeable and objectionable image quality defects, such as streaking and banding that extend in the process direction of a printed image. This is true during the initial manufacture of a device, as well as maintenance and calibration needs as a device ages. As mentioned, the graininess and/or clustering characteristics of images produced by a printhead may be adjusted for each printhead. In imaging devices that are configured to form images onto an intermediate transfer surface, e.g., a rotating drum or belt, prior to transfixing the image onto a media sheet, drop position differences between printheads may be detected by scanning the images on the drum using an image sensor and correlating the scans to a graininess level for the printheads in a known manner. Once a graininess level has been determined for the printheads, the graininess level for one or more of the printheads can be adjusted in an effort to normalize the printheads so that the images produced by adjacent printheads have approximately the same level of graininess.

One difficulty faced in the graininess normalization routine described above is that the structure of images on the intermediate transfer surface is not easy to correlate to the graininess in an image. It is particularly difficult to measure and modify a single jet parameter to control the overall graininess in a half-toned image which is composed of numerous jets. What is needed is a specific pattern which can be easily measured on a single jet basis and corrected such that the overall graininess of the final image is improved.

SUMMARY

A method of detecting the graininess of one or more printheads of an imaging device has been developed that enables graininess detection and adjustments to be made using an inline image sensor. In particular, a method of operating a printhead of an imaging device includes actuating a plurality of ink jets of the printhead to emit drops of ink onto an image receiving surface in accordance with a test pattern. The test pattern includes full pixel density areas and half pixel density areas that alternate in a process direction. Process direction distances between drops of the full pixel density areas and drops of the half pixel density areas in transition regions of the test pattern are then measured. The measured process direction distances are then modified to enhance the quality of the graininess level for the printhead.

In another embodiment, a method of normalizing graininess differences between printheads of an imaging device includes actuating a plurality of ink jets of a first printhead of an imaging device to emit drops of ink onto an image receiving surface in accordance with a test pattern, and actuating a plurality of ink jets of a second printhead of the imaging device to emit drops of ink onto an image receiving surface in accordance with the test pattern. The test pattern includes full pixel density areas and half pixel density areas that alternate in a process direction. Process direction distances between drops of the full pixel density areas and drops of the half pixel density areas in transition regions of the test pattern are then measured for the test patterns printed by both the first and the second printheads. The measured process direction distances are then modified to reduce variation or enhance the quality of the graininess level for each of the first and the second printheads.

In yet another embodiment, a system for detecting graininess levels of one or more printheads of an imaging device includes a test pattern including full pixel density areas and half pixel density areas that alternate in a process direction. The system also includes a controller configured to generate drop ejecting signals for at least one printhead based on the test pattern. An image sensor operably coupled to the controller and configured to scan images formed in accordance with the test pattern and to generate signals indicative of process direction distances between drops of the full pixel density areas and drops of the half pixel density areas in transition regions between the full pixel density areas and the half pixel density areas.

DETAILED DESCRIPTION

Figure 1:
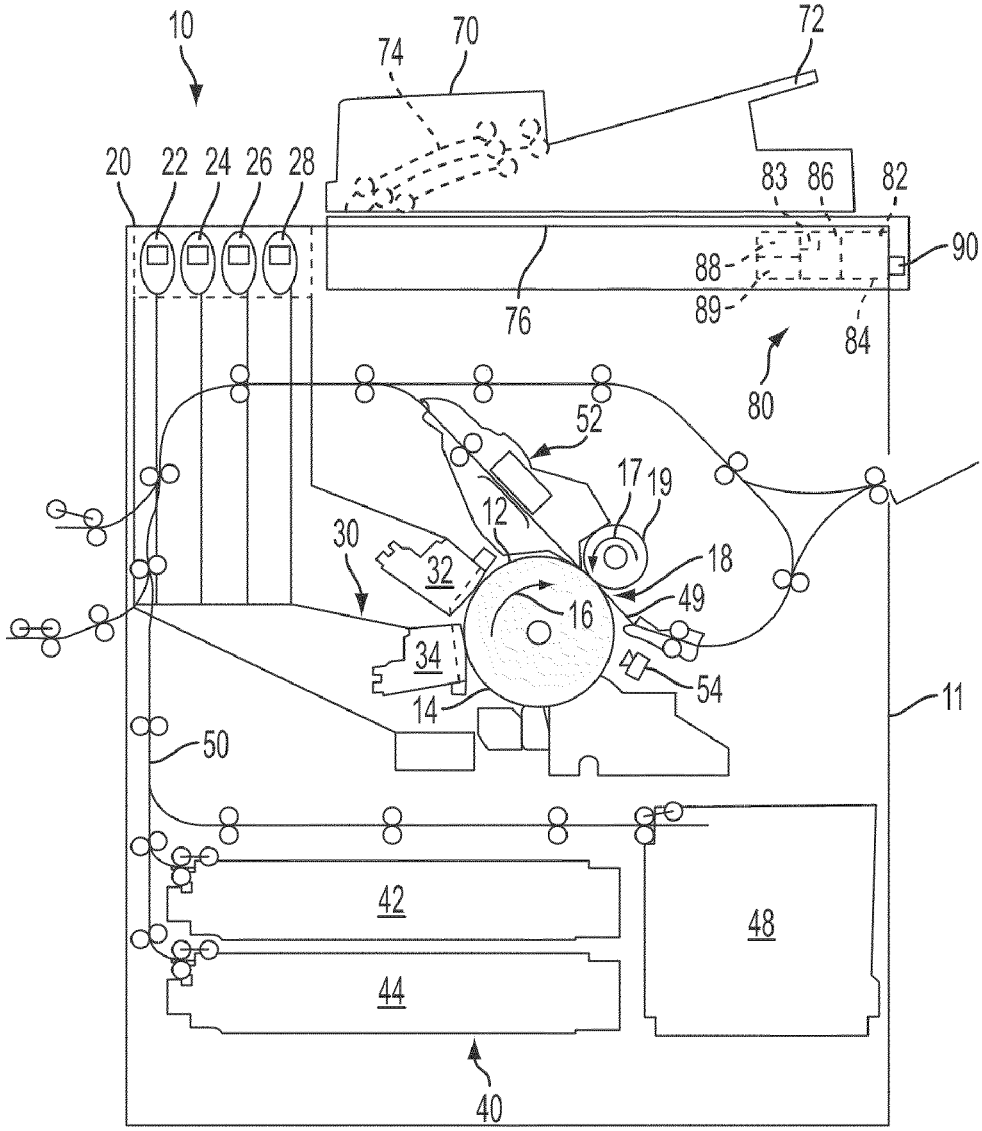
FIG. 1 is a schematic elevational view of an embodiment of an imaging device.

For a general understanding of the present embodiments, reference is made to the drawings. In the drawings, like reference numerals have been used throughout to designate like elements.

As used herein, the terms "printer" or "imaging device" generally refer to a device for applying an image to print media and may encompass any apparatus, such as a digital copier, bookmaking machine, facsimile machine, multi-function machine, etc. which performs a print outputting function for any purpose. "Print media" can be a physical sheet of paper, plastic, or other suitable physical print media substrate for images, whether precut or web fed. The imaging device may include a variety of other components, such as finishers, paper feeders, and the like, and may be embodied as a copier, printer, or a multifunction machine. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like. As used herein, the process direction is the direction in which an individual jet forms an inked line during imaging and is also the direction in which the substrate moves through the imaging device. The cross-process direction, along the same plane as the substrate, is substantially perpendicular to the process direction.

Referring now to FIG. 1, an embodiment of an imaging device 10 of the present disclosure, is depicted. As illustrated, the device 10 includes a frame 11 to which are mounted directly or indirectly all its operating subsystems and components, as described below. In the embodiment of FIG. 1, imaging device 10 is an indirect marking device that includes an intermediate imaging member 12 that is shown in the form of a drum, but can equally be in the form of a supported endless belt. The imaging member 12 has an image receiving surface 14 that is movable in the direction 16, and on which phase change ink images are formed. A transfix roller 19 rotatable in the direction 17 is loaded against the surface 14 of drum 12 to form a transfix nip 18, within which ink images formed on the surface 14 are transfixed onto a media sheet 49. In alternative embodiments, the imaging device may be a direct marking device in which the ink images are formed directly onto a receiving substrate such as a media sheet or a continuous web of media.

The imaging device 10 also includes an ink delivery subsystem 20 that has at least one source 22 of one color of ink. Since the imaging device 10 is a multicolor image producing machine, the ink delivery system 20 includes four (4) sources 22, 24, 26, 28, representing four (4) different colors CYMK (cyan, yellow, magenta, black) of ink. In one embodiment, the ink utilized in the imaging device 10 is a "phase-change ink," by which is meant that the ink is substantially solid at room temperature and substantially liquid when heated to a phase change ink melting temperature for jetting onto an imaging receiving surface. Accordingly, the ink delivery system includes a phase change ink melting and control apparatus (not shown) for melting or phase changing the solid form of the phase change ink into a liquid form. The phase change ink melting temperature may be any temperature that is capable of melting solid phase change ink into liquid or molten form. In one embodiment, the phase change ink melting temperate is approximately 100° C. to 140° C. In alternative embodiments, however, any suitable marking material or ink may be used including, for example, aqueous ink, oil-based ink, UV curable ink, or the like.

The ink delivery system is configured to supply ink in liquid form to a printhead system 30 including at least one printhead assembly 32. Since the imaging device 10 is a high-speed, or high throughput, multicolor device, the printhead system 30 includes multicolor ink printhead assemblies and a plural number (e.g. four (4)) of separate printhead assemblies (32, 34 shown in FIG. 1).

As further shown, the imaging device 10 includes a media supply and handling system 40. The media supply and handling system 40, for example, may include sheet or substrate supply sources 42, 44, 48, of which supply source 48, for example, is a high capacity paper supply or feeder for storing and supplying image receiving substrates in the form of cut sheets 49, for example. The substrate supply and handling system 40 also includes a substrate or sheet heater or preheater assembly 52. The imaging device 10 as shown may also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 for example is a self-contained, dedicated mini-computer having a central processor unit (CPU) 82, electronic storage 84, and a display or user interface (UI) 86. The ESS or controller 80 for example includes a sensor input and control system 88 as well as a pixel placement and control system 89. In addition the CPU 82 reads, captures, prepares and manages the image data flow between image input sources such as the scanning system 76, or an online or a work station connection 90, and the printhead assemblies 32, 34, 36, 38. As such, the ESS or controller 80 is the main multi-tasking processor for operating and controlling all of the other machine subsystems and functions, including the printhead cleaning apparatus and method discussed below.

In operation, image data for an image to be produced are sent to the controller 80 from either the scanning system 76 or via the online or work station connection 90 for processing and output to the printhead assemblies 32, 34, 36, 38. Additionally, the controller determines and/or accepts related subsystem and component controls, for example, from operator inputs via the user interface 86, and accordingly executes such controls. As a result, appropriate color solid forms of phase change ink are melted and delivered to the printhead assemblies. Additionally, pixel placement control is exercised relative to the imaging surface 14 thus forming desired images per such image data, and receiving substrates are supplied by any one of the sources 42, 44, 48 along supply path 50 in timed registration with image formation on the surface 14. Finally, the image is transferred from the surface 14 and fixed or fused to the copy sheet within the transfix nip 18.

The imaging device may include an inline image sensor 54 operably positioned within the imaging device to scan images formed on the intermediate transfer surface. The inline image sensor is in communication with controller 10 and is configured to generate a digital image of at least a portion of the surface of the transfer drum, and, in particular, of images formed on the drum. The controller may use the digital image generated by the image sensor to determine parameters such as drop positions, intensities, locations, and the like of drops jetted onto the transfer surface by the inkjets of the print head assembly. In one embodiment, the image sensor includes a light source (not shown) and a light sensor (not shown). The light source may be actuated by the controller to direct light onto marks formed on the transfer surface. The reflected light is measured by the light sensor. The signals indicative of the magnitude of the reflected light may be processed by the controller in a known manner to determine the number and location of contaminated ink jets in a printhead.

Figure 2:
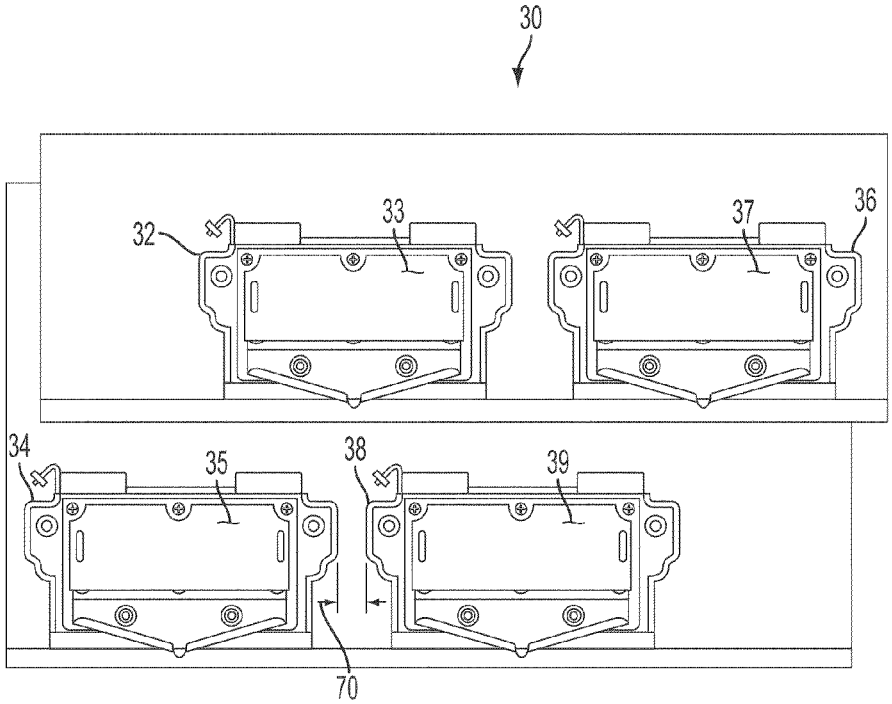
FIG. 2 is a perspective view of the arrangement of printheads in the imaging device of FIG. 1.

Referring now to FIG. 2, the printer/copier 10 described in this example is a high-speed, or high throughput, multicolor image producing machine, having four printheads, including upper printheads 32 and 36, and lower printheads 34 and 38. Each printhead 32, 34, 36 and 38 has a corresponding front face, or ejecting face, 33, 35, 37 and 39 for ejecting ink onto the receiving surface 14 to form an image. While forming an image, a mode referred to herein as print mode, the upper printheads 32, 36 may be staggered with respect to the lower printheads 34, 38 in a direction transverse to the receiving surface path 16 (FIG. 1) in order to cover different portions of the receiving surface 14. The staggered arrangement enables the printheads to form an image across the full width of the substrate.

Figure 3:
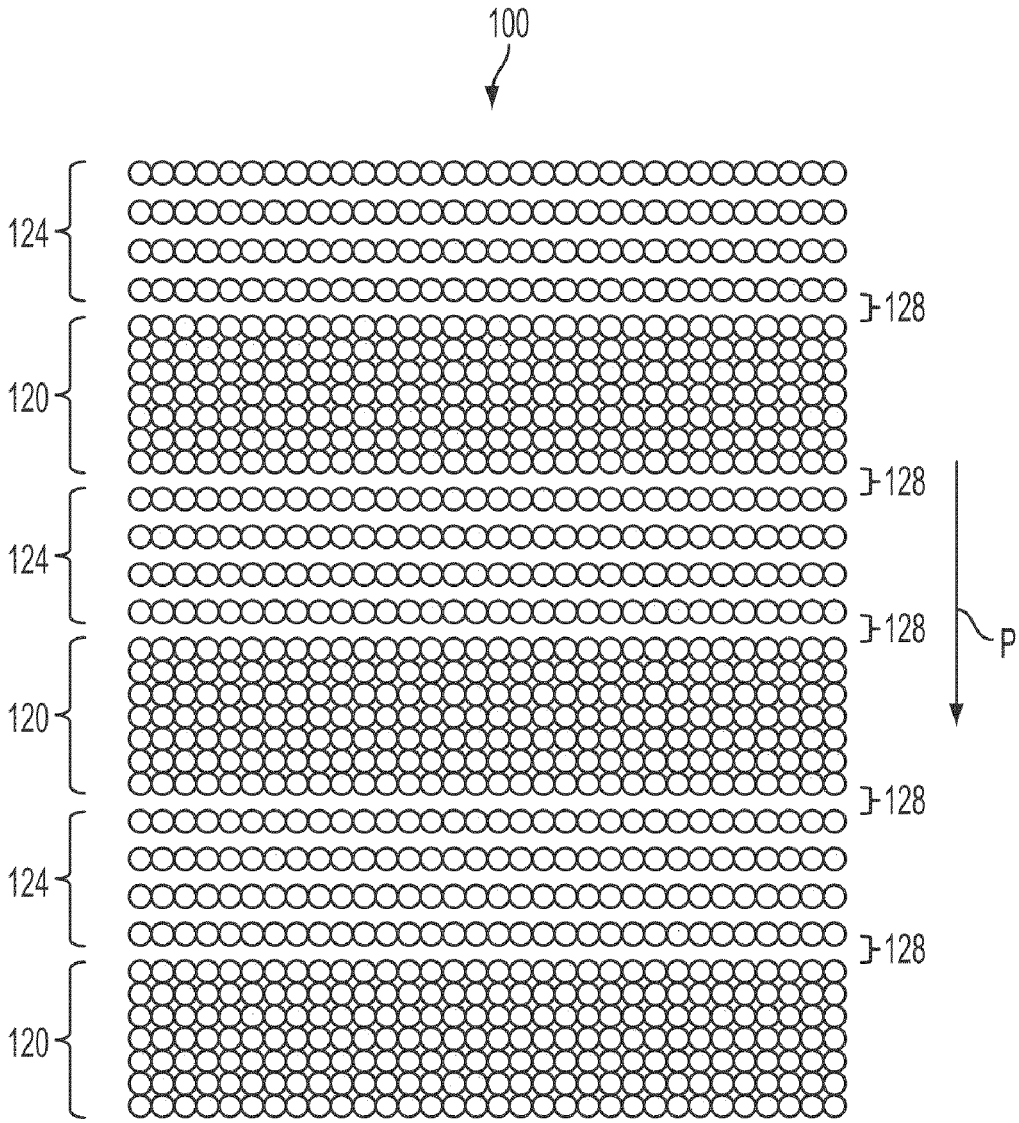
FIG. 3 depicts an embodiment of a test pattern for detecting graininess of a printhead.

A test pattern and procedure has been developed that enables inline detection and quantification of the graininess level of a printhead and to enable automatic graininess/clustering adjustments. FIG. 3 shows an exemplary embodiment of such a test pattern 100. As seen in FIG. 3, the pattern 100 includes alternating full frequency areas 120, i.e., areas where the pixels are printed at the full operational frequency of the jet, and half frequency areas 124, i.e., areas where the pixels are printed at half the operational frequency of the jet, with pixel separation of 1 pixels. The full and half frequency areas alternate along the process direction P.

Figure 4A:
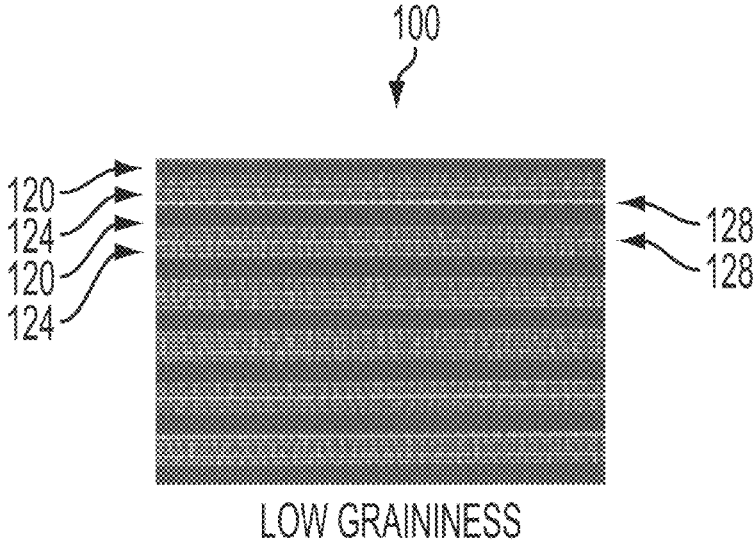
FIGS. 4*a*-4*c* show printouts of the test pattern from a printhead having low graininess (FIG. 4*a*), medium graininess (FIG. 4*b*), and high graininess (FIG. 4*c*).
Figure 4B:
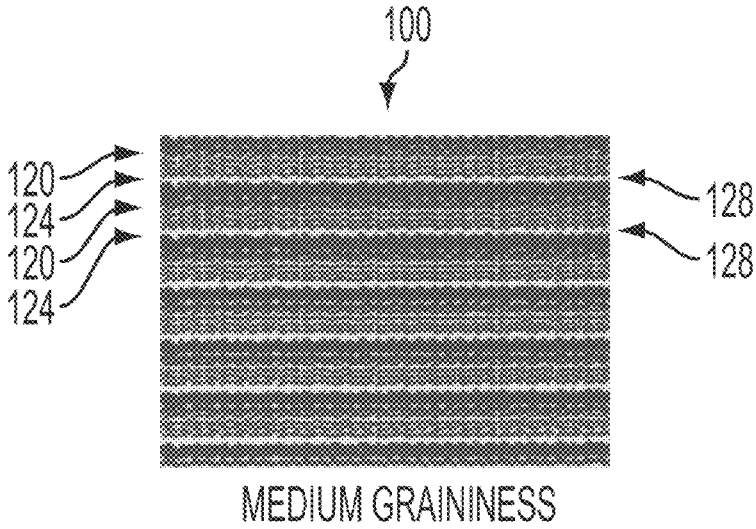
Figure 4C:
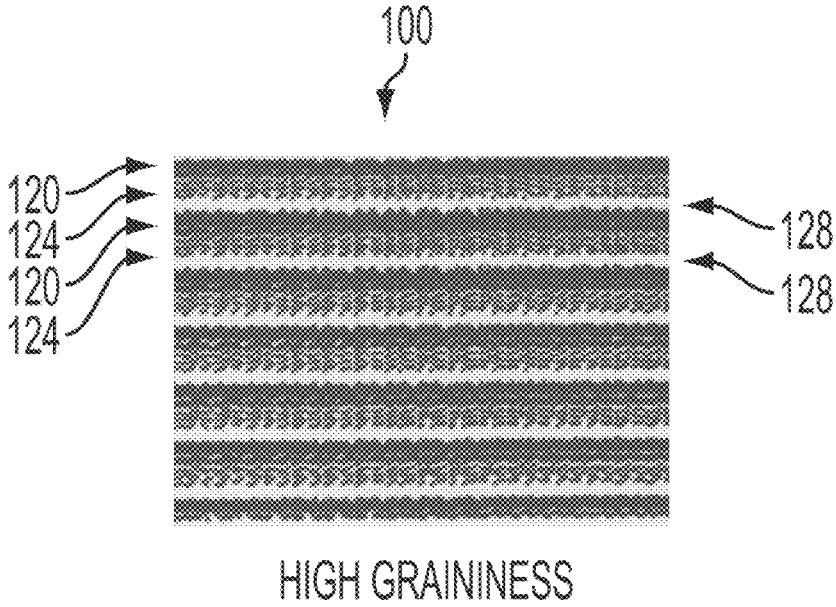

When the different heads were tested using the test pattern of FIG. 3, a correlation was found to exist between the graininess of the resulting printouts and the differences in the full-to-half frequency transitions 128 for the printouts. For example, FIGS. 4*a*-4*c* show printouts of the test pattern 100 from different printheads having different levels of graininess. FIG. 4*c* shows a printout of the test pattern by a printhead having little to no graininess. FIG. 4*b* shows a printout of the test pattern having a medium level of graininess/clustering, and FIG. 4*c* shows a printout of the test pattern by a printhead having a high level of graininess. As seen in FIGS. 4*a*-4*c*, a correlation exists between the graininess of the printheads and the transitions 128 between the full pixel density areas 120 and the half pixel density areas 124 of the printed test patterns. Therefore, measurement of the transition spacing which can be easily done on a head or jet basis can be used to quantify and correct the image graininess on a head or jet basis.

Figure 5:
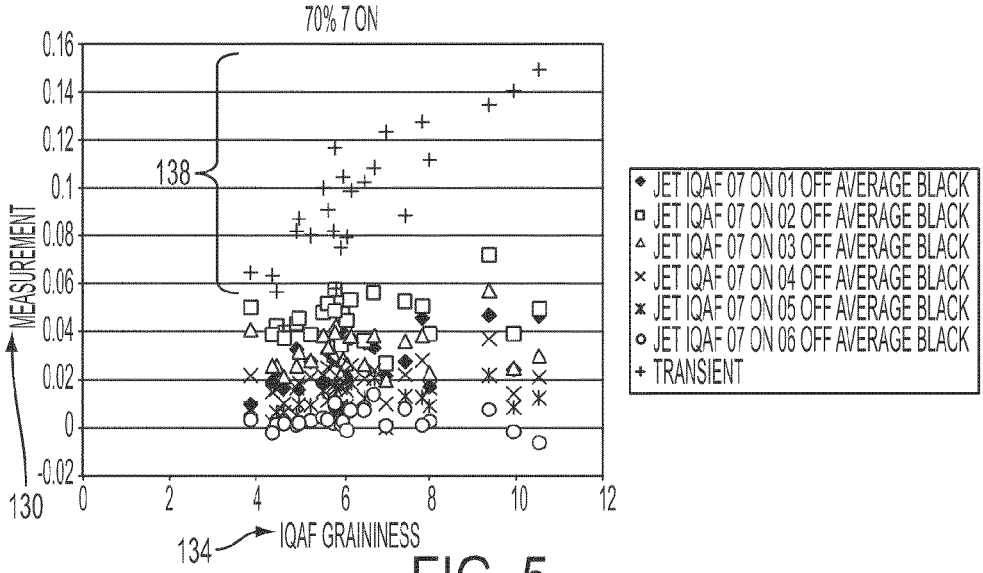
FIGS. 5 and 6 are graphs of the measured pixel separation between full pixel density areas and half pixel density areas of a printed test pattern versus an IQAF graininess value for the printhead.
Figure 6:
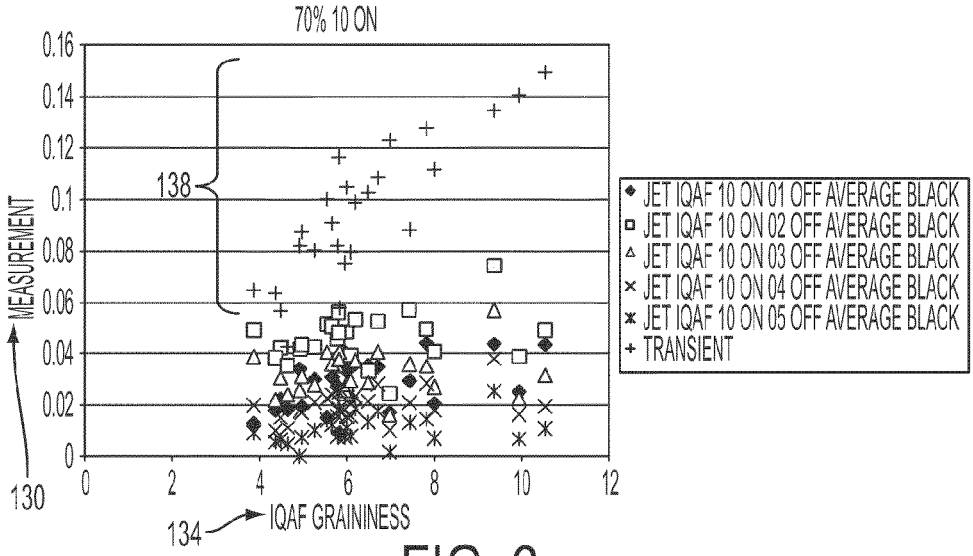
Figure 8:
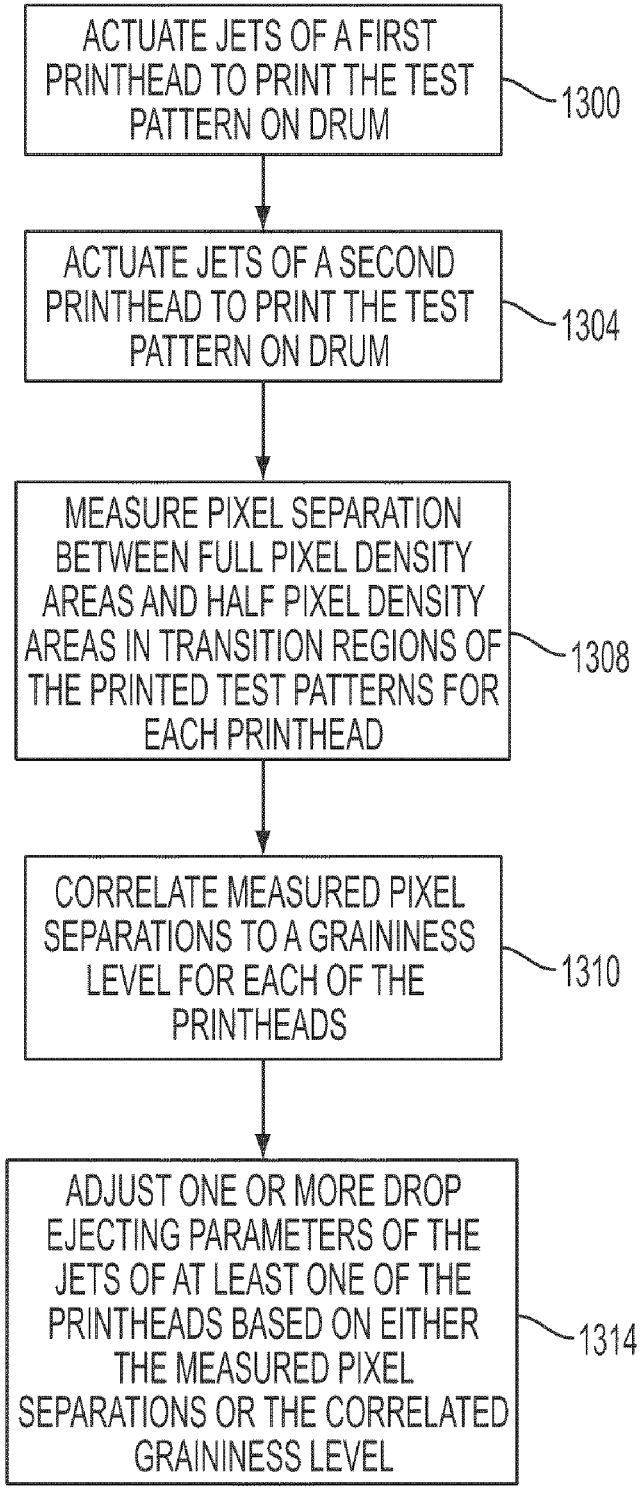
FIG. 8 is a flowchart of a method of normalizing graininess differences between printheads using the test pattern of FIG. 3.

To test the ability of the inline image sensor to detect the graininess/clustering of the printheads based on the test pattern of FIG. 3, tests were conducted in which the printheads were actuated to print the test pattern 100 and the inline image sensor was used to scan the printed patterns on the transfer drum to detect the distances between pixels of the full pixel density areas and the half pixel density areas in the transition regions. Graininess was also measured on these printheads using an image quality analysis facility (IQAF) used widely in various systems available from Xerox. FIGS. 5 and 6 show graphs of the inline image sensor measurements 130 of the pixel separations 128 between the full frequency area pixels 120 and the half frequency area pixels 124 in the transition regions versus the IQAF graininess level 134 detected by the IQAF. The graphs of FIGS. 5 and 6 show the pixel separation measurements between the full and half frequency lines in a 70% halftone. As seen in FIGS. 5 and 8, the measured pixel separations 138 in the transition region increases with the IQAF graininess levels 134 detected by the IQAF thus indicating that a correlation exists between the graininess and the transition measurements. All the other marks on the graphs were the numerous stray pixel measurements (none of which showed any correlation to graininess).

Figure 7:
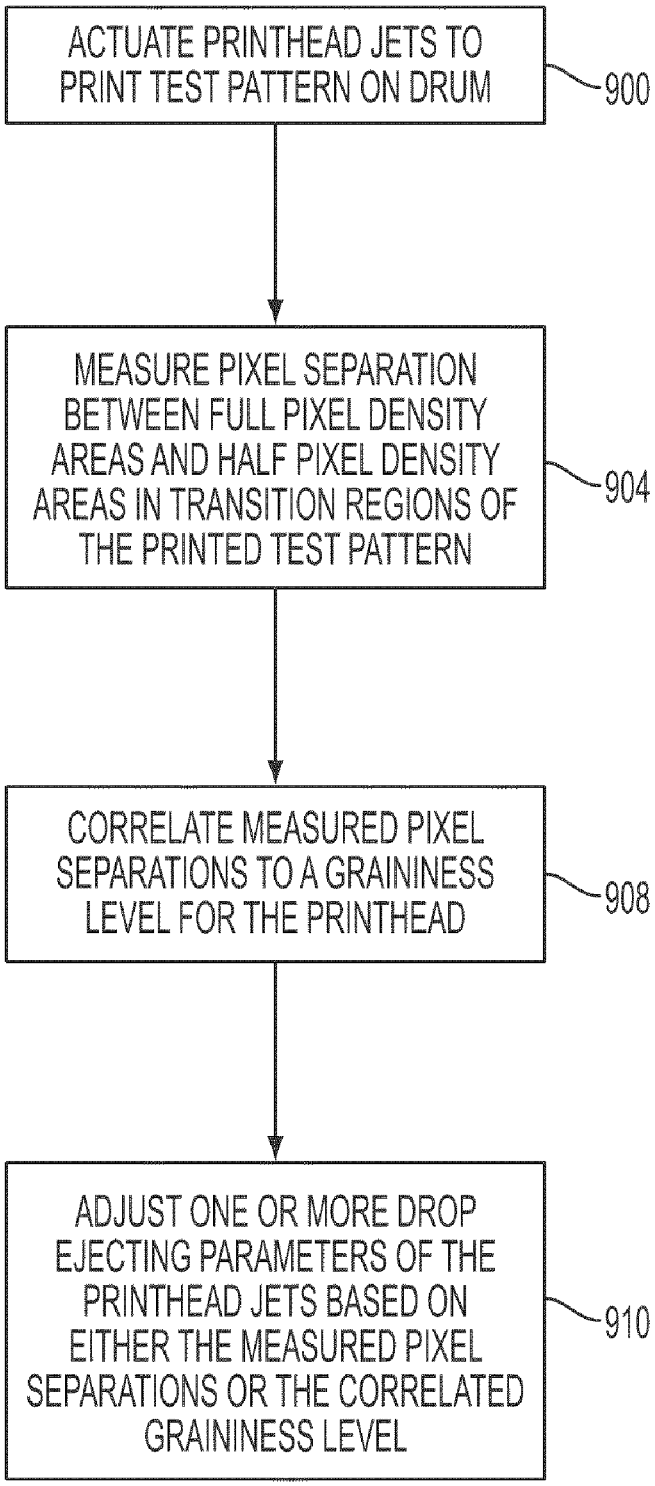
FIG. 7 is a flowchart of a method of detecting and adjusting graininess of a printhead using the test pattern of FIG. 3.

FIG. 7 is a flowchart of an embodiment of a method of detecting and adjusting the graininess/clustering level of a printhead using the test pattern of FIG. 3. According to the method of FIG. 7, a plurality of ink jets of a printhead of an imaging device are actuated to emit drops of ink onto an image receiving surface in accordance with the test pattern (block 900). As mentioned, the test pattern includes full frequency areas and half frequency areas that alternate in a process direction along the image receiving surface. As used herein, a "test pattern" comprises data, such as, for example, a bitmap, that may be stored in a memory accessible by the controller and that indicates from which ink jets/nozzles to eject drops and timings for the actuations. The test pattern may be created and stored in the memory during system design or manufacture. Alternatively, the controller may include software, hardware and/or firmware that are configured to generate test patterns "on the fly." The controller is operable to generate drop ejecting signals for driving the ink jets to eject drops through the corresponding nozzles in accordance with the test pattern.

Once the test pattern has been formed on the image receiving surface, the distance, i.e., pixel separation, between pixels of the full pixel density regions and the half pixel density areas are measured (block 904). The measurement may be performed using the inline image sensor of the imaging device. The measured distances or pixel separations may then be correlated to a graininess level for the printhead (block 908). The correlation between transition measurements and graininess levels may be performed in any suitable manner. For example, in one embodiment, the sensor values output by the inline image sensor for the transition regions may be used as a lookup value for accessing a lookup table that is populated with possible sensor values and associated graininess values.

Once a graininess level has been determined for a printhead, the graininess of the printhead may be adjusted (block 910). The graininess level for a printhead may be adjusted based on the measured pixel separations of the test pattern and/or the correlated graininess level for the printhead. Testing has shown that image graininess and/or clustering is adjustable by modifying one or more operating parameters of the printhead and/or one or more jets of the printhead. Adjustments may be made to operating parameters of each ink jet of a printhead based on the graininess level of the printhead. Alternatively, adjustments may be made to the operating parameters of one or more select ink jets of the printhead based on the measured graininess of the printhead. Examples of operating parameters that may be modified to adjust the graininess of images output by a printhead include the adjustment of one or more components of the drop ejecting signals for one, a few, or all of the ink jets, such as a waveform tail voltage or dancing jet voltage, but any timing or amplitude could be used. Another drop ejecting parameter that may be modified to adjust the graininess is printhead temperature.

In another embodiment, graininess adjustments may be made by modifying a tone reproduction curve (TRC) associated with the printhead. As is known in the art, image data supplied to a printer is typically in a continuous tone (i.e., contone) format. TRC's are used to map the contone image data to halftone image data that may be used to actuate the printheads of the imaging device to form images. TRC's may also be used to adjust pixel values to compensate for the characteristics of a particular marking engine. Accordingly, graininess adjustments may be made by generating or modifying a TRC for the printhead as a function of the determined graininess levels and/or the transition measurements.

In one embodiment, an operating parameter may be adjusted by generating a correction parameter based on the measured transition distances that may be used to modify the corresponding operating parameter. For example, the correction parameter may comprise a waveform tail voltage value, dancing jet voltage, printhead temperature value, and the like that may be used when the printhead is being operated to form images. Alternatively, the correction parameters may comprise values that may be added to or subtracted from the corresponding operating parameter. Similarly, the correction parameter may comprise data for modifying a TRC for the printheads.

FIG. 8 is a flowchart of an embodiment of a method of detecting graininess and normalizing graininess differences between printheads using the test pattern of FIG. 3. According to the method, a plurality of ink jets of a first printhead of an imaging device is actuated to emit drops of ink onto an image receiving surface in accordance with a test pattern having full frequency areas and half frequency areas that alternate in a process direction (block 1300). A plurality of ink jets of a second printhead of the imaging device is also actuated to emit drops of ink onto the image receiving surface in accordance with the test pattern (block 1304). The test patterns may be printed at the same or different times.

Once the test patterns have been formed on the image receiving surface, the distance, i.e., pixel separation, between pixels of the full frequency regions and the half frequency areas of the test patterns are measured (block 1308). The measurements may be performed using the inline image sensor of the imaging device. The measured distances or pixel separations for the test patterns may then be correlated to a graininess level for each of the first and the second printheads (block 1310). The correlation between transition measurements and graininess levels may be performed in any suitable manner. For example, in one embodiment, the sensor values output by the inline image sensor for the transition regions may be used as a lookup value for accessing a lookup table that is populated with possible sensor values and associated graininess values Once a graininess level for the first and second printheads has been determined, the graininess level of at least one of the first and second printheads may be adjusted so that the graininess levels of the printheads are approximately the same (block 1314). The graininess level for a printhead may be adjusted based on the measured pixel separations of the test pattern and/or the correlated graininess level for the printhead. As mentioned, graininess levels of a printhead may be adjusted by modifying one or more components of the drop ejecting signals for the ink jets of the printheads, adjusting the operating temperature of the printheads, and/or by modifying the TRC for the printhead.

It will be appreciated that various of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. A method of operating a printhead of an imaging device, the method comprising:

actuating a plurality of ink jets of a printhead of an imaging device to emit drops of ink onto an image receiving surface in accordance with a test pattern, the test pattern including full pixel density areas and half pixel density areas that alternate in a process direction along the image receiving surface;

measuring distances in a process direction between drops of the full pixel density areas and drops of the half pixel density areas in transition regions between the full pixel density areas and the half pixel density areas; and correlating the measured distances to a graininess level for the printhead.

2. The method of claim 1, the measurement of the distances further comprising:

scanning the test pattern using an inline image sensor of the imaging device to generate a digital image of the test pattern; and measuring the distances in the process direction using the digital image of the test pattern.

3. The method of claim 2, further comprising:

generating a correction parameter for at least one operating parameter of at least one ink jet in the plurality of ink jets based on the measured distances; and modifying the at least one operating parameter based on the generated correction parameter.

4. The method of claim 3, the generation of the correction parameter further comprising:

generating a correction parameter for modifying at least one component of drop ejecting signals for at least one ink jet in the plurality of ink jets.

5. The method of claim 4, the generation of the correction parameter further comprising:

generating a tail voltage correction parameter for modifying a tail voltage of the drop ejecting signals for at least one ink jet in the plurality of ink jets.

6. The method of claim 4, the generation of the correction parameter further comprising:

generating a dancing jet voltage correction parameter for modifying a dancing jet voltage for at least one ink jet in the plurality of ink jets.

7. The method of claim 4, the generation of the correction parameter further comprising:

generating a printhead temperature correction parameter for modifying a printhead operating temperature.

8. The method of claim 4, the generation of the correction parameter further comprising:

generating a tone reproduction curve (TRC) correction parameter for modifying a TRC of the printhead.

9. The method of claim 3, the adjustment of the drop ejecting parameter further comprising:

adjusting a tone reproduction curve (TRC) of at least one of the first and the second printheads based on the measured distances.

10. Method of operating a printhead assembly including a plurality of printheads, the method comprising:

actuating a plurality of ink jets of a first printhead of an imaging device to emit drops of ink onto an image receiving surface in accordance with a test pattern, the test pattern including full pixel density areas and half pixel density areas that alternate in a process direction along the image receiving surface;

actuating a plurality of ink jets of a second printhead of the imaging device to emit drops of ink onto an image receiving surface in accordance with the test pattern;

measuring process direction distances between drops of the full pixel density areas and drops of the half pixel density areas in transition regions between the full pixel density areas and the half pixel density areas for the test patterns printed by both the first and the second printheads;

correlating the measured process direction distances to a graininess level for each of the first and the second printheads.

11. The method of claim 10, the measurement of the process direction distances further comprising:

scanning the test patterns using an inline image sensor of the imaging device, the inline image sensor being configured to generate signals indicative of the distances.

12. The method of claim 11, the actuation of the plurality of ink jets further comprising:

generating a plurality of drop ejecting signals for the plurality of ink jets; and providing the plurality of drop ejecting signals to the plurality of ink jets to cause the plurality of ink jets to emit drops of ink.

13. The method of claim 12, further comprising:

adjusting a drop ejecting parameter for at least one of the first and the second printheads based on the measured distances.

14. The method of claim 13, the adjustment of the drop ejecting parameter further comprising:

adjusting a component of the drop ejecting signals for at least one ink jet in the plurality of ink jets of at least one of the first and the second printheads based on the measured distances.

15. The method of claim 14, the adjustment of the component further comprising:

adjusting a tail voltage of the drop ejecting signals for at least one ink jet in the plurality of ink jets of at least one of the first and the second printheads based on the measured distances.

16. The method of claim 14, the adjustment of the drop ejecting parameter further comprising:

adjusting an operating temperature of at least one of the first and the second printheads based on the measured distances.

17. A system for detecting graininess levels of one or more printheads of an imaging device, the system comprising:

a test pattern including full pixel density areas and half pixel density areas that alternate in a process direction;

an image sensor operably coupled to the controller and configured to scan images formed in accordance with the test pattern and to generate signals indicative of process direction distances between drops of the full pixel density areas and drops of the half pixel density areas in transition regions between the full pixel density areas and the half pixel density areas; and a controller operably coupled to the image sensor to receive the signals generated by the image sensor, the controller being configured to generate drop ejecting signals for at least one printhead based on the test pattern, to measure the process direction distances between drops of the full pixel density areas and drops of the half pixel density areas in transition regions between the full pixel density areas and the half pixel density areas, and to correlate the measured process direction distances to a graininess level for the at least one printhead.

18. The system of claim 17, the controller being configured to adjust a drop ejecting parameter for the at least one printhead based on the measured process direction distances.

* * * * *